US007140505B2

(12) United States Patent
Roubal et al.

(10) Patent No.: US 7,140,505 B2
(45) Date of Patent: Nov. 28, 2006

(54) BASE DESIGN FOR PASTEURIZATION

(75) Inventors: Ed Roubal, Stewartstown, PA (US); David A. Kesselman, York, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 11/020,176

(22) Filed: Dec. 27, 2004

(65) Prior Publication Data

US 2006/0138075 A1 Jun. 29, 2006

(51) Int. Cl.
*B65D 1/44* (2006.01)

(52) U.S. Cl. ..... 215/373; 215/10; 220/606

(58) Field of Classification Search ..... 215/10, 215/373, 375; 206/509; 220/606, 608, 609
See application file for complete search history.

(56) References Cited

U.S. PATENT DOCUMENTS

| | | | | |
|---|---|---|---|---|
| 3,757,978 | A * | 9/1973 | Gilbert | 215/371 |
| 3,917,095 | A * | 11/1975 | Seefluth | 215/371 |
| 4,134,510 | A * | 1/1979 | Chang | 215/373 |
| 4,249,666 | A * | 2/1981 | Hubert et al. | 215/373 |
| 4,620,639 | A * | 11/1986 | Yoshino | 215/373 |
| 5,469,984 | A * | 11/1995 | Kalkanis | 220/606 |
| 6,409,035 | B1 * | 6/2002 | Darr et al. | 215/373 |
| 6,464,106 | B1 * | 10/2002 | Giblin et al. | 222/109 |
| 6,585,123 | B1 * | 7/2003 | Pedmo et al. | 215/10 |
| 6,637,612 | B1 * | 10/2003 | Maczek | 215/373 |
| 2002/0074336 | A1 * | 6/2002 | Silvers | 220/623 |
| 2003/0221987 | A1 * | 12/2003 | Trude | 206/508 |
| 2004/0164048 | A1 * | 8/2004 | Yourist | 215/398 |

FOREIGN PATENT DOCUMENTS

| | | | |
|---|---|---|---|
| GB | 2164914 A | * | 4/1986 |
| WO | WO 92/06897 | * | 4/1992 |

* cited by examiner

*Primary Examiner*—Sue A. Weaver
(74) *Attorney, Agent, or Firm*—Stuart I. Smith; Caroline J. Swindell; Venable LLP

(57) ABSTRACT

A container base may include a standing ring defining a touch point for contact with a horizontal surface, where the standing ring has an outer portion and an inner portion, and merges with the container sidewall. The base may also have a stacking ring having an inner portion and an outer portion, where the outer portion merges with the inner portion of the standing ring. The base may further have a substantially circular recessed portion coupled to the inner portion of the stacking ring, comprising: a plurality of substantially flat concentric rings recessed from the stacking ring, wherein each ring is recessed from the next outermost adjacent ring; a substantially flat center coupled to an inner diameter of an innermost substantially flat ring and recessed therefrom; and a cross-brace extending from the stacking ring into the substantially flat center.

14 Claims, 14 Drawing Sheets

BASE DESIGN FOR PASTEURIZATION

CROSS-REFERENCE TO RELATED APPLICATIONS

The present application is related to U.S. patent application Ser. No. 29/211,810, filed Aug. 23, 2004 entitled "Container," to Heisner et al., of common assignee to the present invention, the contents of which are incorporated herein by reference in their entirety.

BACKGROUND OF THE INVENTION

1. Field of the Invention

The present invention relates generally to container bases, and more particularly to stacking container bases that can withstand pasteurization.

2. Related Art

Stackable bases in large containers are desirable to improve ease of storing the container. However, some conventional stackable bases are not able to withstand the heat and pressures associated with pasteurization.

Plastic blow-molded containers, particularly those molded of PET, have been utilized in hot fill applications where the container is filled with a liquid product heated to a temperature in excess of 180° F. (82° C.), capped immediately after filling, and allowed to cool to ambient temperatures. Plastic blow-molded containers have also been utilized in pasteurization and retort processes, where a filled and sealed container is subjected to thermal processing and is then cooled to ambient temperatures. Pasteurization and retort methods are frequently used for sterilizing solid or semi-solid food products, e.g., pickles and sauerkraut, which may be packed into the container along with a liquid at a temperature less than 82° C. (180° F.) and then heated, or the product placed in the container that is then filled with liquid, which may have been previously heated, and the entire contents subsequently heated to a higher temperature.

Pasteurization and retort differ from hot-fill processing by including heating the contents of a filled container to a specified temperature, typically greater than 93° C. (200° F.), until the contents reach a specified temperature, for example 80° C. (175° F.), for a predetermined length of time. Retort processes also involve applying overpressure to the container.

Plastic containers have replaced or provided an alternative to glass containers for many applications. However, few food products that must be processed using pasteurization or retort are available in plastic containers. The rigors of such processing present significant challenges for the use of plastic containers, including containers designed for use in hot-fill processing. There remains a need to provide plastic containers that can withstand the rigors of pasteurization and retort processing in order to take advantage of the cost savings that can be realized through manufacture and recycling. The lighter weight of plastic containers as compared to glass can also advantageously reduce shipping costs.

What is needed then is an container base that overcomes shortcomings of conventional solutions.

BRIEF SUMMARY OF THE INVENTION

Accordingly, embodiments of the present invention provide a base structure for a plastic, wide-mouth, blow-molded container which is particularly suited for packaging a variety of viscous and other food products and which has a novel base structure that enables the container to be utilized in hot-fill, pasteurization and retort processes. The base structures in the various embodiments are capable of accommodating increased internal pressure experienced during pasteurization; capable of accommodating vacuum formed in the sealed container during cool down; and capable of resisting unwanted inversion, ovalization or like deformation. Additionally, embodiments of the present invention are capable of efficient stacking with like containers.

In an exemplary embodiment, the present invention may be a container base for a container having a sidewall, the base comprising: a standing ring defining a touch point for contact with a horizontal surface, the standing ring having an outer portion and an inner portion, the outer portion merging with the container sidewall; a stacking ring having an inner portion and an outer portion, wherein the outer portion merges with the inner portion of the standing ring; and a substantially circular recessed portion coupled to the inner portion of the stacking ring, comprising: a plurality of substantially flat concentric rings recessed from the stacking ring, wherein each ring is recessed from the next outermost adjacent ring; a substantially flat center coupled to an inner diameter of an innermost substantially flat ring and recessed therefrom; and a cross-brace extending from the stacking ring into the substantially flat center.

In another exemplary embodiment, the present invention may be a container base for a container having a sidewall, the base comprising: a standing ring defining a touch point for contact with a horizontal surface, the standing ring having an outer portion and an inner portion, the outer portion merging with the container sidewall; a stacking ring having an inner portion and an outer portion, wherein the outer portion merges with the inner portion of the standing ring; and a substantially circular recessed portion coupled to the inner portion of the stacking ring and recessed therefrom, comprising: a substantially circular recessed wall merging with the stacking ring; and a corrugated support panel having an outer diameter merging with the recessed wall, and having substantially parallel corrugations extending from a first side of the recessed portion to an opposite second side of the recessed portion and merging with the recessed wall.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

Figure 1:
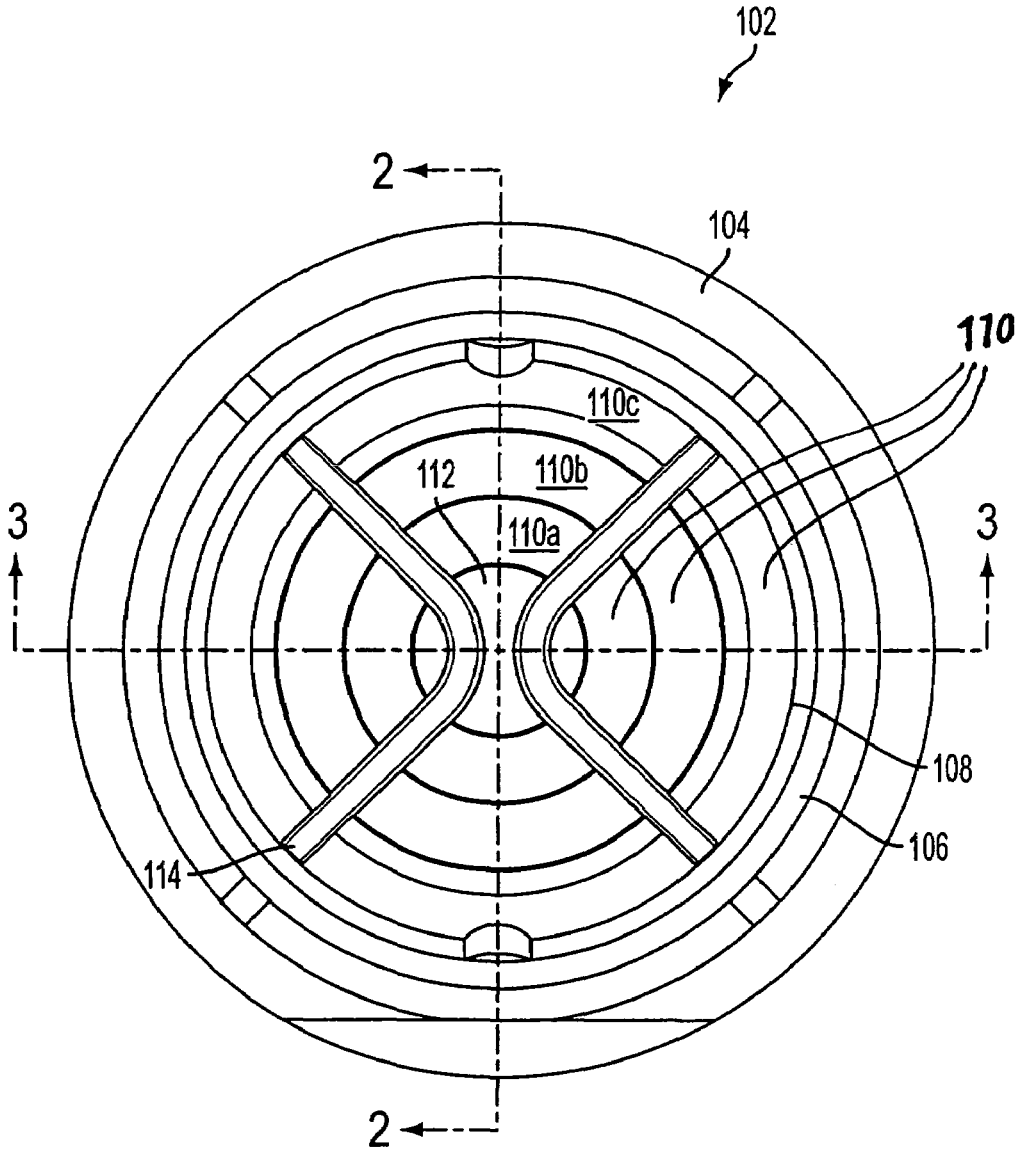
FIG. 1 depicts an exemplary embodiment of a first embodiment of a container base according to the present invention.

FIG. 1 depicts an exemplary embodiment of a first embodiment 102 of a container base according to the present invention. The base may be comprised of a standing ring 104, defining a touch point for contact with a horizontal surface. The standing ring 104 has an outer portion and an inner portion, the outer portion merging with the container sidewall. The base 102 also has a stacking ring 106 recessed from the standing ring 104 and having an inner portion and an outer portion, where the outer portion merges with the inner portion of the standing ring 104. (See, e.g., FIGS. 2 and 3).

The base 102 further has a recessed portion 108 coupled to the inner portion of the stacking ring 106. The recessed portion 108 may have a plurality of substantially flat concentric rings 110*a*, 110*b*, 110*c* (collectively 110) recessed from the stacking ring, where each ring 110 is recessed from the next outermost adjacent ring. The rings 110 may have the same general shape as the footprint of the base, for example, round, oval, or rectangular. While FIG. 1 shows three rings 110, the invention is not limited to three rings, and other embodiments may have more or fewer rings. The base 102 further may have a substantially flat center 112 coupled to an inner diameter of the innermost substantially flat ring 110*a* and be recessed from the ring 110*a*.

The base 102 may further have one or more cross-braces 114 extending from the stacking ring 106 into the substantially flat center 112. The cross-brace 114 provides additional structural support to the container and base that prevent deformation of the base during the pasteurization process. The cross-brace 114 may be substantially co-planar with the stacking ring 106. The cross-brace 114 may have a first leg and a second leg joined at a bend, where the bend contacts the substantially flat center 112. The legs may extend outwardly from the bend up to the stacking ring 106 while in contact with each of the substantially flat concentric rings 110.

The bend in the cross-brace 114 may form an approximate right angle. The base 102 may have at least two bent cross-braces, or more. In a base 102 having two bent cross-braces 114, the cross-braces 114 may be arranged such that the first leg of the first cross-brace and the first leg of the second cross-brace are substantially co-linear, and the second leg of the first cross-brace and the second leg of the second cross-brace are substantially co-linear.

Figure 14:
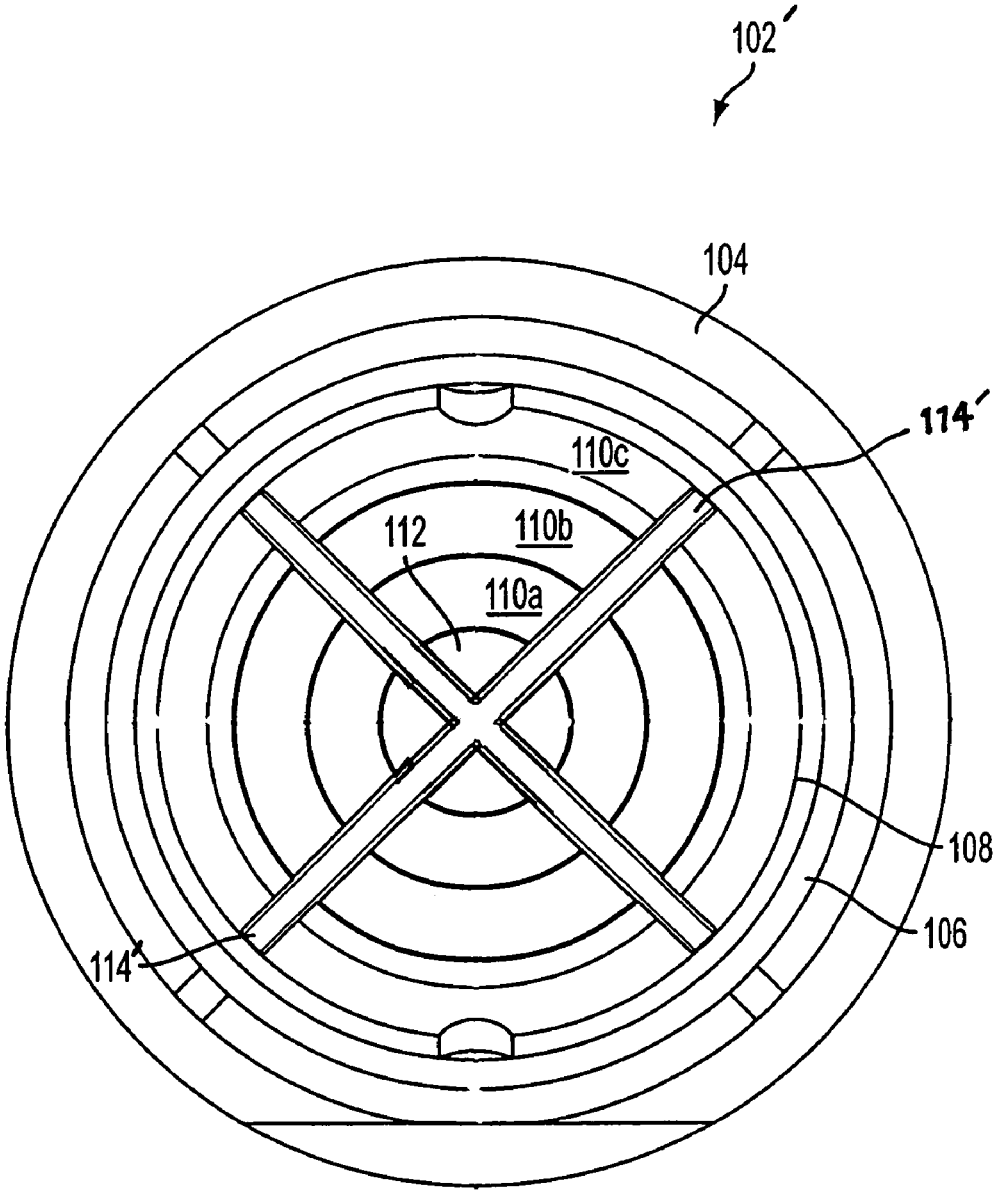
FIG. 14 depicts an exemplary embodiment of a fifth embodiment of a container base according to the present invention.

In an alternative embodiment 102' (shown in FIG. 14), the cross-brace 114' may extend from one side of the stacking ring 106, through the substantially flat center 112 to an opposite side of the stacking ring 106. A second cross-brace 114' may extend from one side of the stacking ring 106, through the substantially flat center 112 to the opposite side of the stacking ring, intersecting the first cross-brace to form an "X" on the base of the container.

The recessed portion 108, especially in combination with cross-brace 114, 114' may provide sufficient support to the base during pasteurization or retort processing. During these extreme conditions, the plastic material of the base, as well as the rest of the container, is heated to a point where the base begins to soften. At the same time, a positive internal pressure develops in the container. This creates a force pushing outwardly on the container base. Traditional bases used in hot-fill processing may not be able to withstand this force, and base roll out, or bulging to the base, is a substantial problem. Bases manufactured according to the present invention have sufficient structural support to prevent base roll out. Thus the shape and integrity of the base can be maintained.

Figure 2:
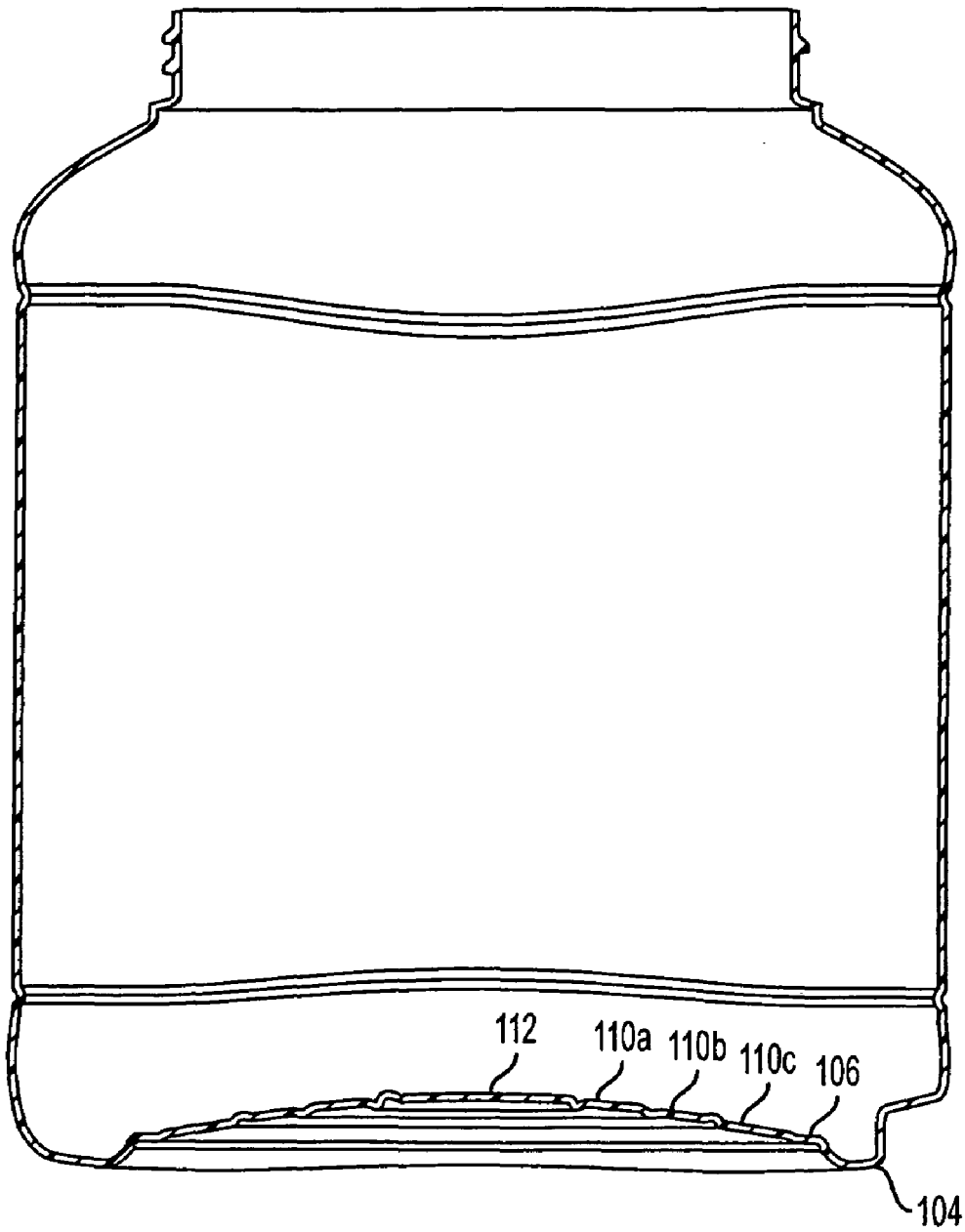
FIG. 2 depicts a cross-section of the container base shown in FIG. 1 along the line 2—2.
Figure 3:
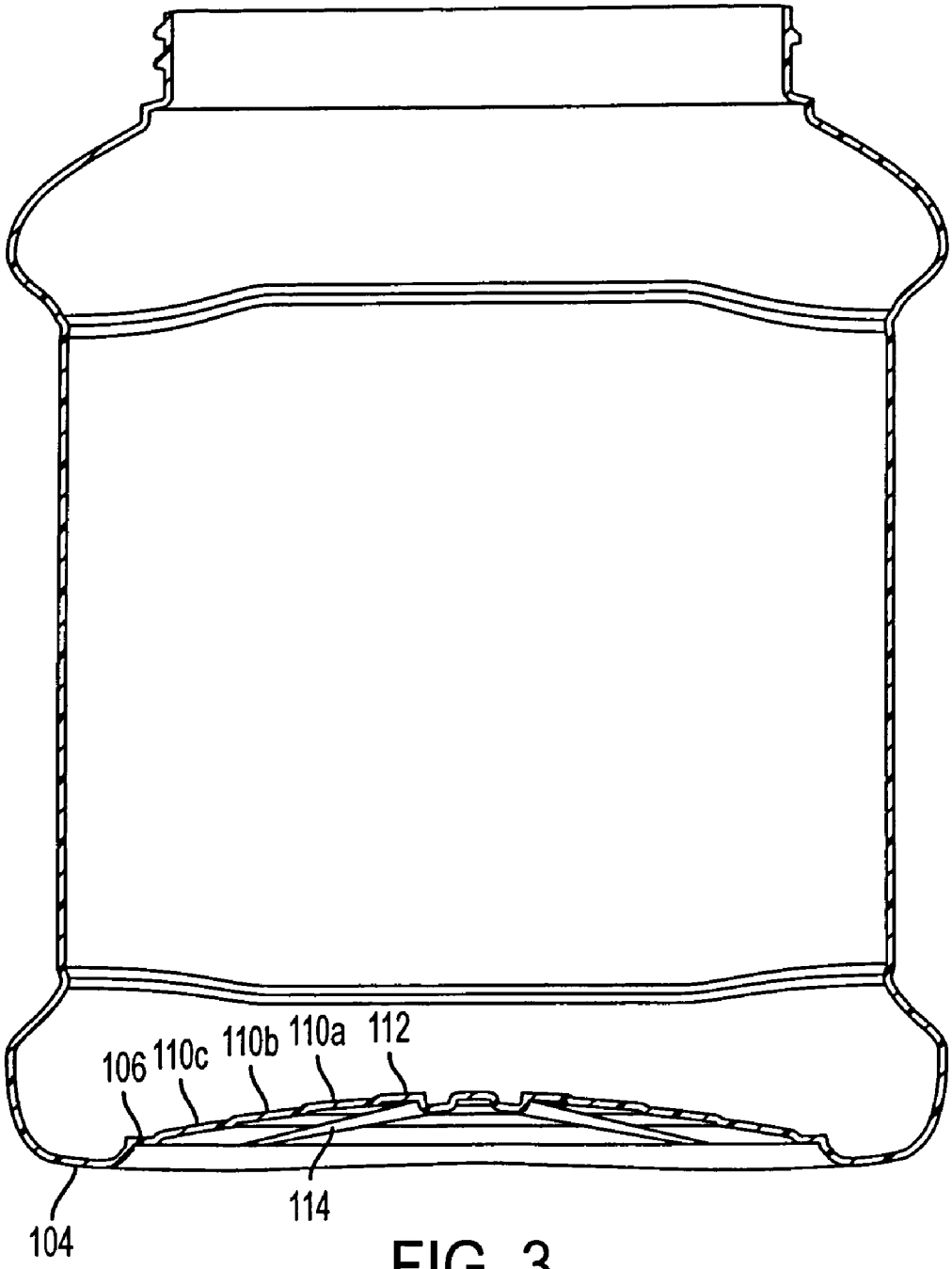
FIG. 3 depicts a cross-section of the container base shown in FIG. 1 along the line 3—3.

The progressive recessing of the rings 110 and the relationship of the cross-braces 114, 114' is apparent from FIGS. 2 and 3. FIG. 2 depicts a cross-section of the container base 102 shown along the line 2—2 in FIG. 1. FIG. 3 depicts a cross-section of the container base 102 shown along the line 3—3 in FIG. 1.

Figure 4:
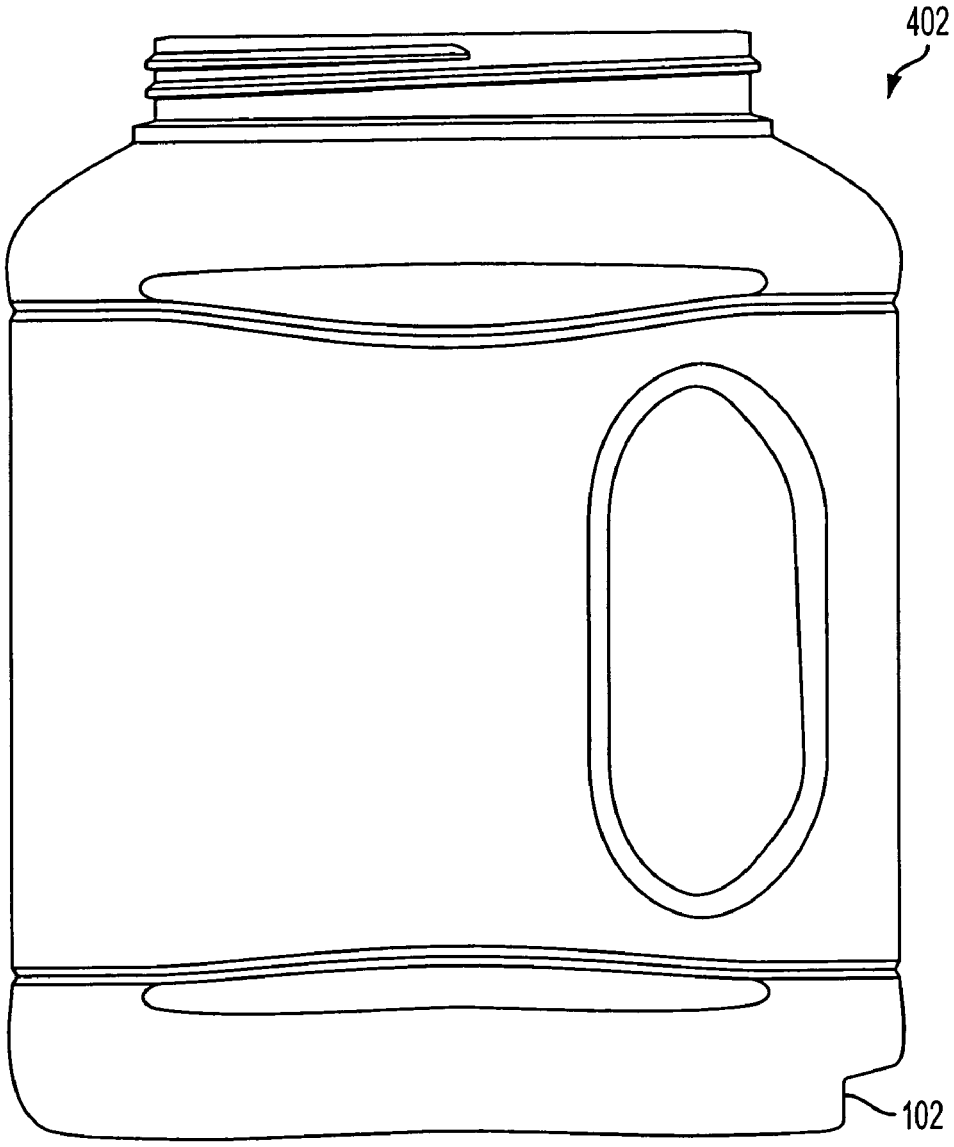
FIG. 4 depicts an exemplary container having a base according to the present invention.

FIG. 4 depicts an exemplary container 402 having a base according to embodiments of the present invention. Containers such as container 402 may be large, wide-opening jars or cans. An exemplary container 402 is described in related U.S. patent application Ser. No. 29/211810. Such containers may hold pasteurized products, and may be especially useful in industrial and commercial food preparation centers, or in the bulk food market. Containers 402 may be stacked one on top of the other, such that the lid of one container fits into the stacking ring 106 of another container's base.

The container 402 including the base may have a one-piece construction and can be prepared from a monolayer plastic material, such as a polyamide, for example, nylon; a polyolefin such as polyethylene, for example, low density polyethylene (LDPE) or high density polyethylene (HDPE), or polypropylene; a polyester, for example polyethylene terephthalate (PET), polyethylene naphtalate (PEN); or others, which can also include additives to vary the physical or chemical properties of the material. For example, some plastic resins can be modified to improve the oxygen permeability. Alternatively, the container can be prepared from a multilayer plastic material. The layers can be any plastic material, including virgin, recycled and reground material, and can include plastics or other materials with additives to improve physical properties of the container. In addition to the above-mentioned materials, other materials often used in multilayer plastic containers include, for example, ethylvinyl alcohol (EVOH) and tie layers or binders to hold together materials that are subject to delamination when used in adjacent layers. A coating may be applied over the monolayer or multilayer material, for example to introduce oxygen barrier properties. In an exemplary embodiment, the present container is prepared from multilayered polypropylene.

The container 402 including the base may be formed by extrusion blow molding. In extrusion blow molding, a molten tube of thermoplastic material, or plastic parison, is extruded between a pair of open blow mold halves. The blow mold halves close about the parison and cooperate to provide a cavity into which the parison is blown to form the container. As formed, the container can include extra material, or flash, at the region where the molds come together, or extra material, or a moil, intentionally present above the container finish. After the mold halves open, the container drops out and is then sent to a trimmer or cutter where any flash of moil is removed. The finished container may have a visible ridge formed where the two mold halves used to form the container came together. This ridge is often referred to as the parting line.

Figure 5:
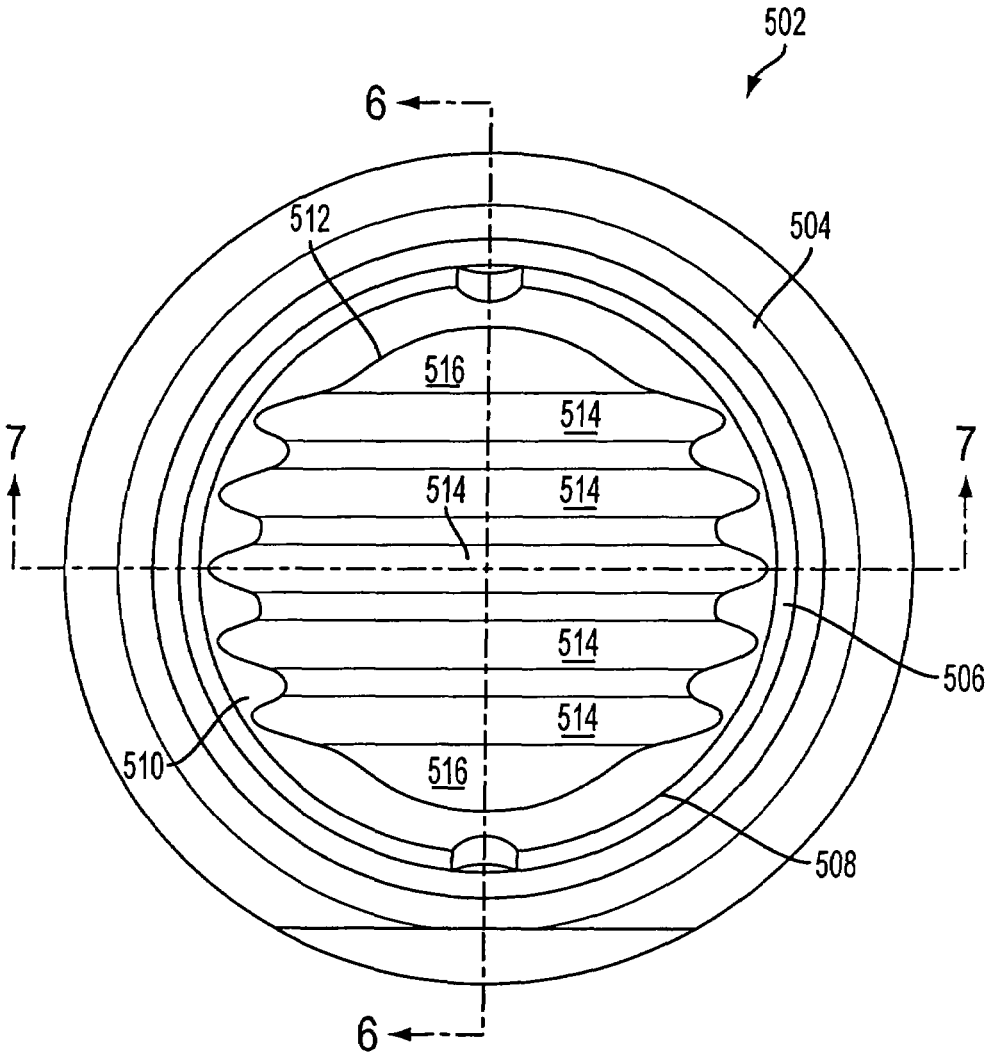
FIG. 5 depicts an exemplary embodiment of a second embodiment of a container base according to the present invention.

FIG. 5 depicts an exemplary embodiment of a second embodiment 502 of a container base according to the present invention. The base 502 may include a standing ring 504 defining a touch point for contact with a horizontal surface. The standing ring may have an outer portion and an inner portion, the outer portion merging with the container sidewall. (See, e.g., FIGS. 6–7). The base 502 may further include a stacking ring 506 having an inner portion and an outer portion, where the outer portion merges with the inner portion of the standing ring 504. The base 502 may also have a recessed portion 508 coupled to the inner portion of the stacking ring 506 and recessed therefrom.

The recessed portion 508 may include a recessed wall 510 merging with the stacking ring 506; and a corrugated support panel 512 having an outer diameter merging with the recessed wall 510. The support panel 512 includes substantially parallel corrugations 514 extending from a first side of the recessed portion 508 to an opposite second side of the recessed portion 508 and merging with the recessed wall 510. The support panel 512 may also have one or more substantially flat regions 516 between the outermost corrugations 514 and the recessed wall 510. Although FIG. 5 shows four or five corrugations 514, any number of corrugations may be used.

Figure 6:
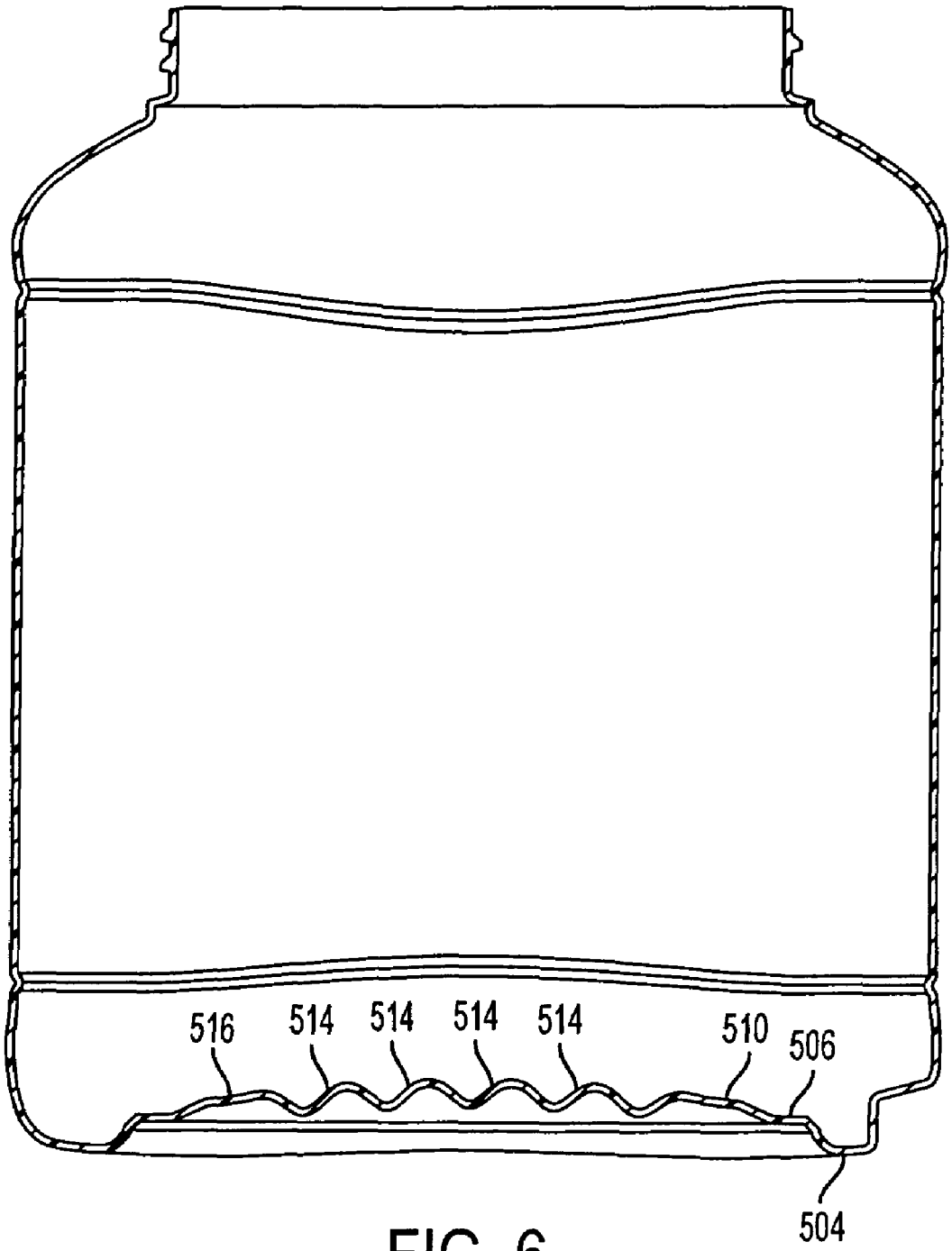
FIG. 6 depicts a cross-section of the container base shown in FIG. 5 along the line 6—6.
Figure 7:
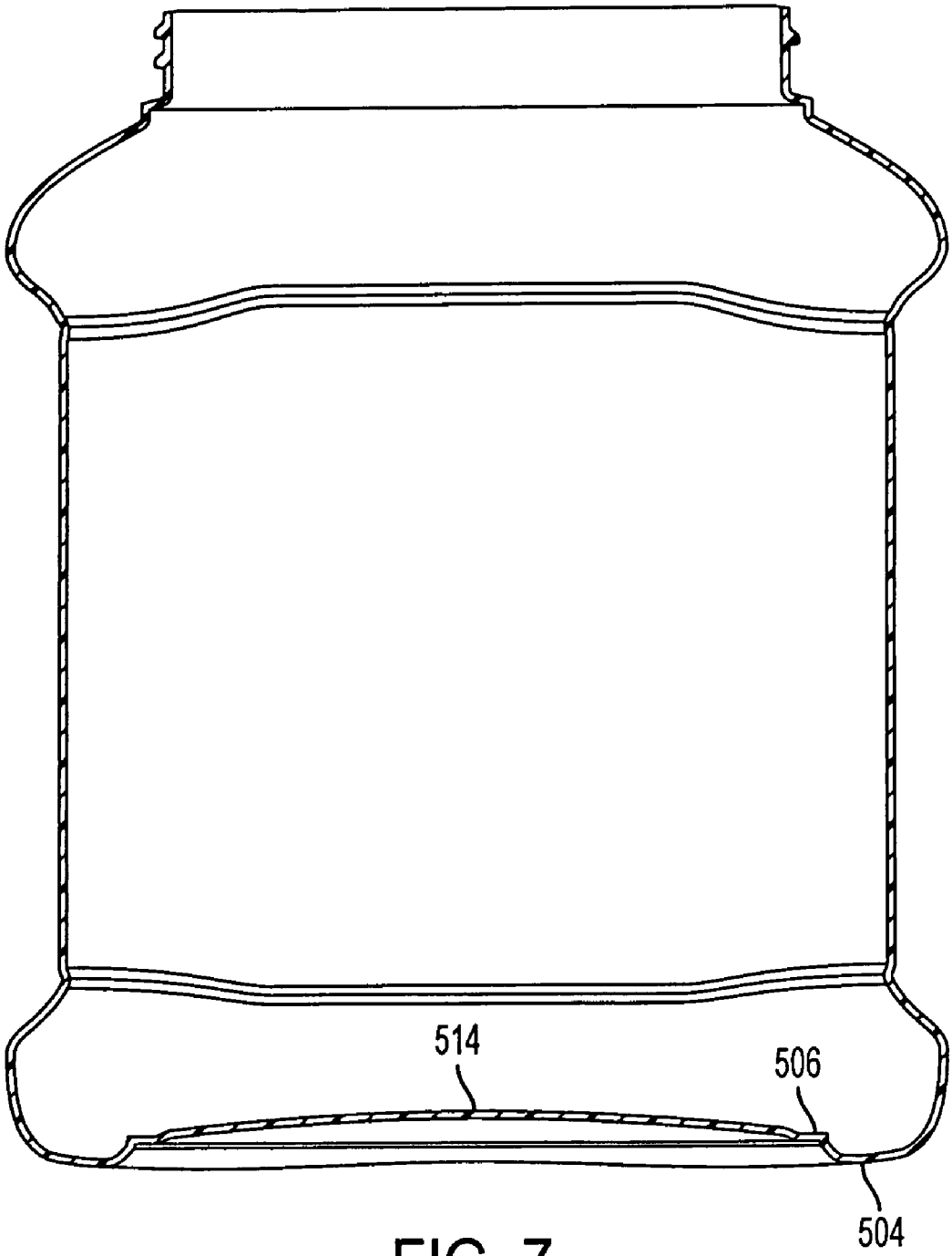
FIG. 7 depicts a cross-section of the container base shown in FIG. 5 along the line 7—7.

The relationship of the corrugations 514 to the base is illustrated in FIGS. 6–7. FIG. 6 depicts a cross-section of the container base 502 shown along the line 6—6 in FIG. 5. FIG. 7 depicts a cross-section of the container base 502 shown along the line 7—7 in FIG. 5.

Figure 8:
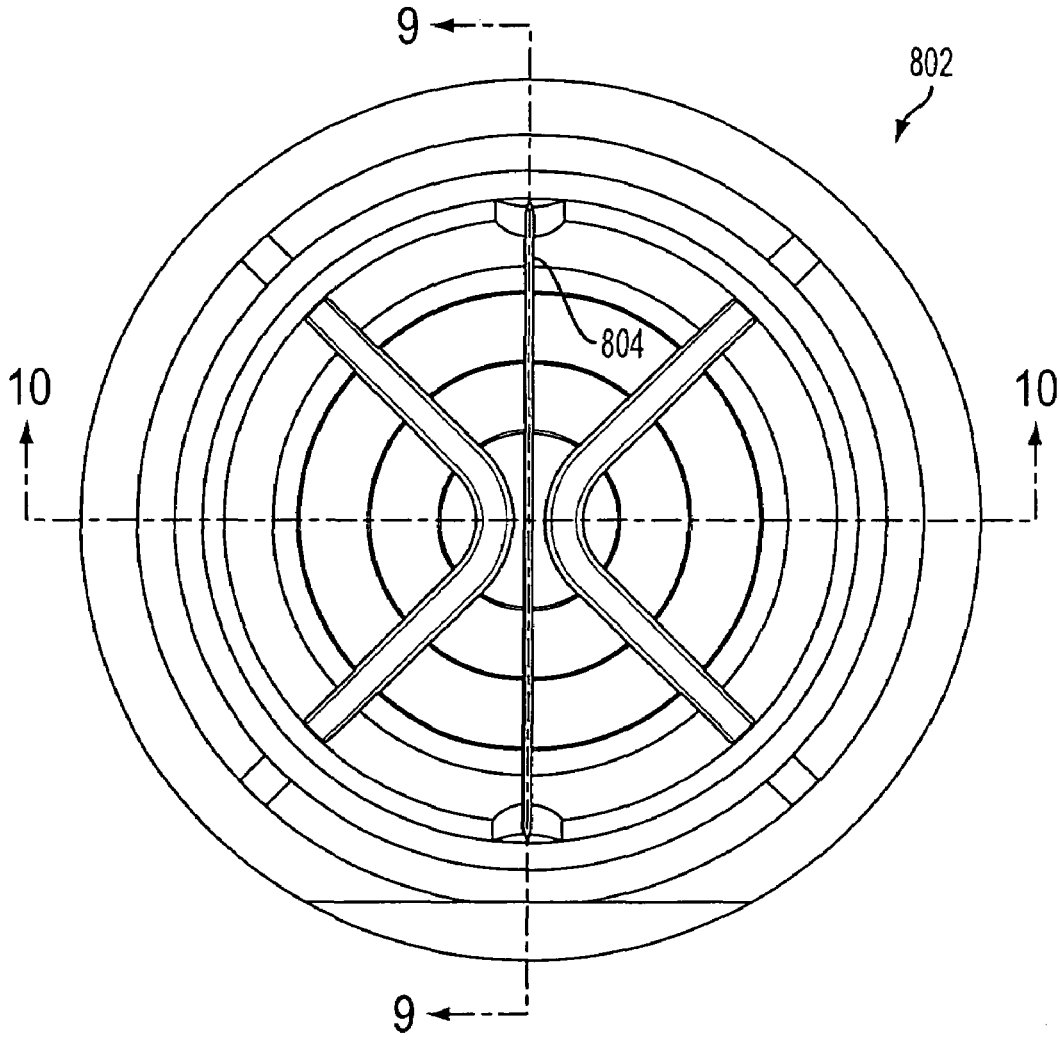
FIG. 8 depicts an exemplary embodiment of a third embodiment of a container base according to the present invention.
Figure 9:
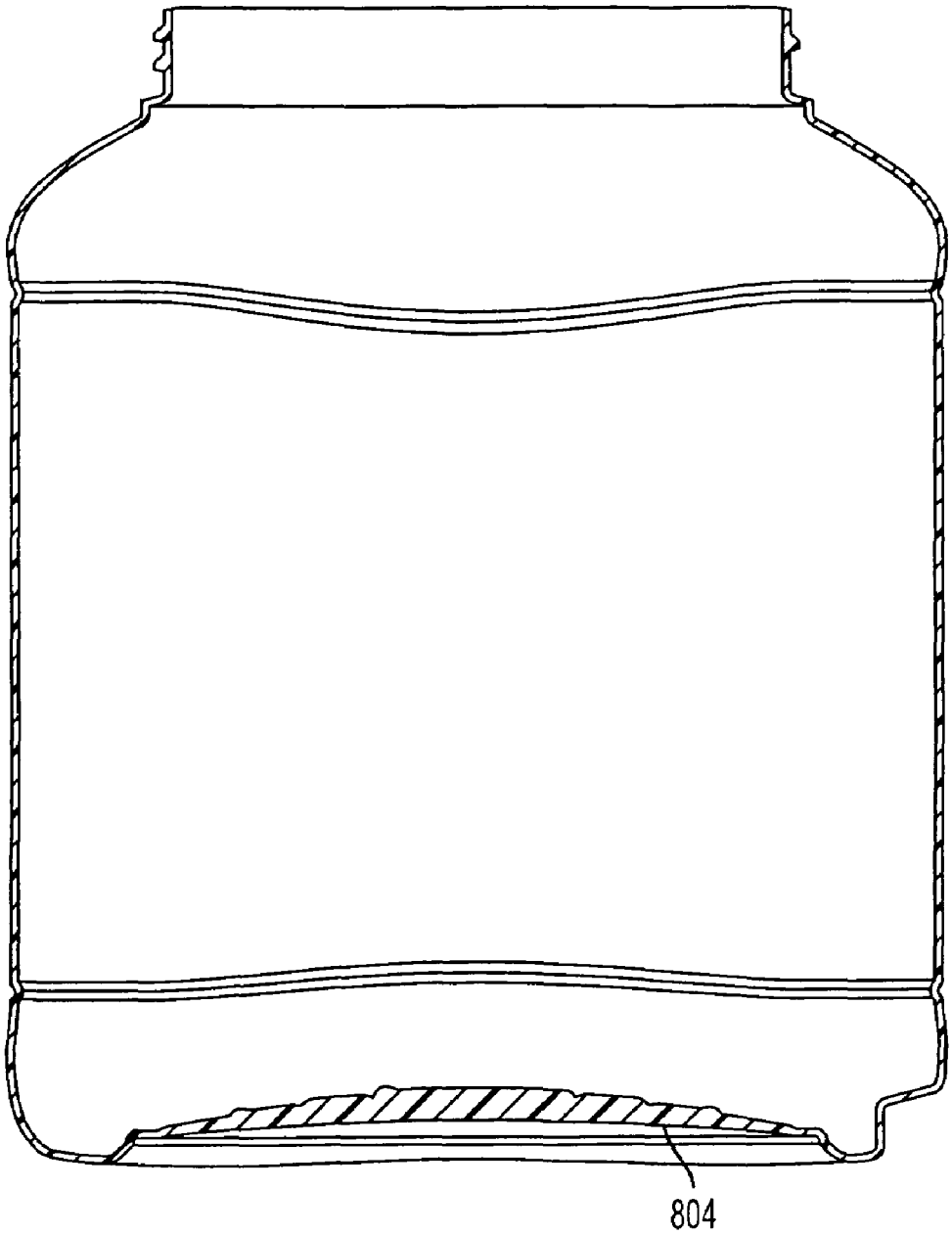
FIG. 9 depicts a cross-section of the container base shown in FIG. 8 along the line 9—9.
Figure 10:
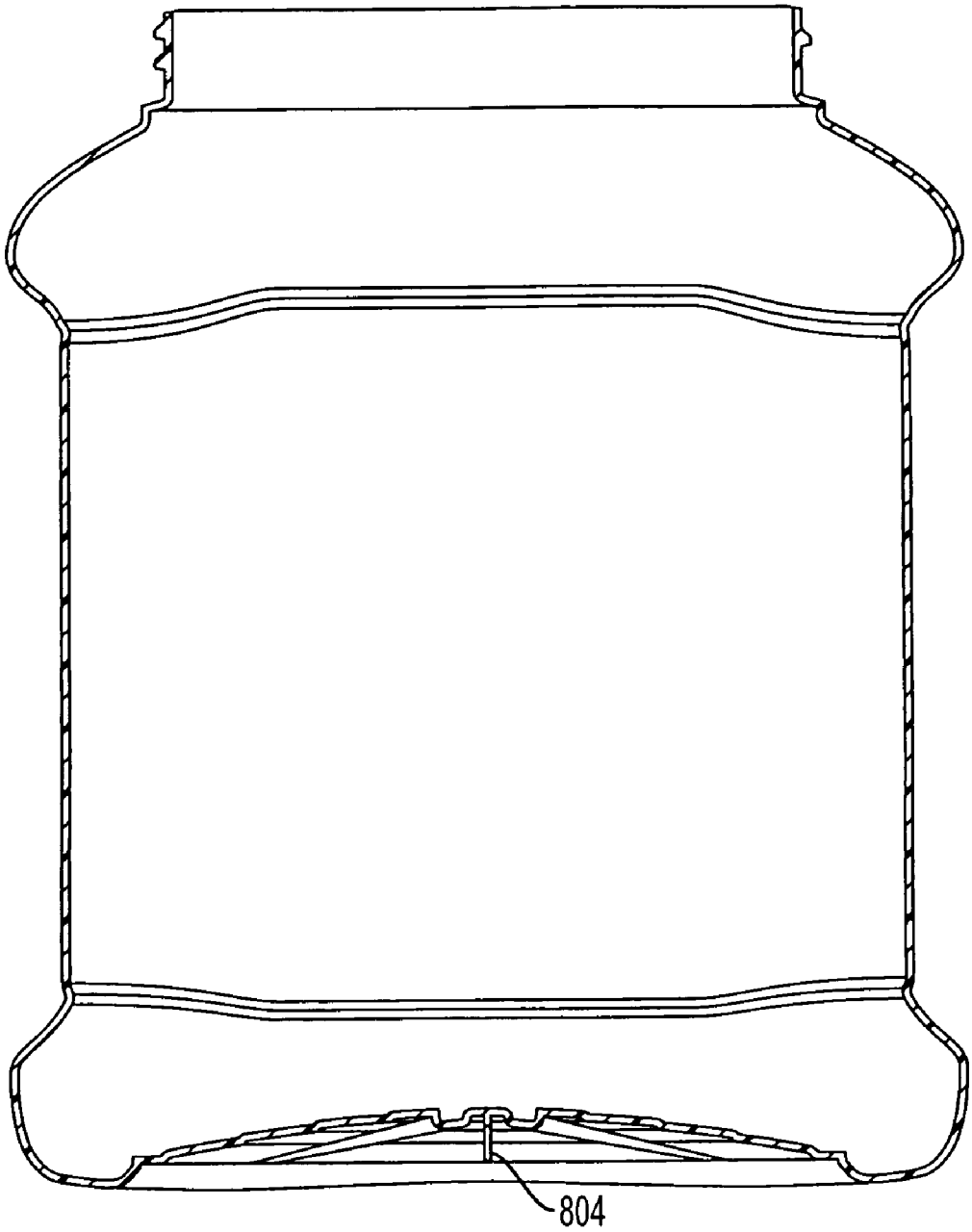
FIG. 10 depicts a cross-section of the container base shown in FIG. 8 along the line 10—10.

FIG. 8 depicts an exemplary embodiment of a third embodiment 802 of a container base according to the present invention. FIG. 9 depicts a cross-section of the container base 802 shown along the line 9—9 in FIG. 8. FIG. 10 depicts a cross-section of the container base 802 shown along the line 10—10 in FIG. 8. Base 802 is substantially similar to base 102, and further includes a substantially linear seam 804. The seam 804 may be extended into a fin to provide additional structural support to the base.

Figure 11:
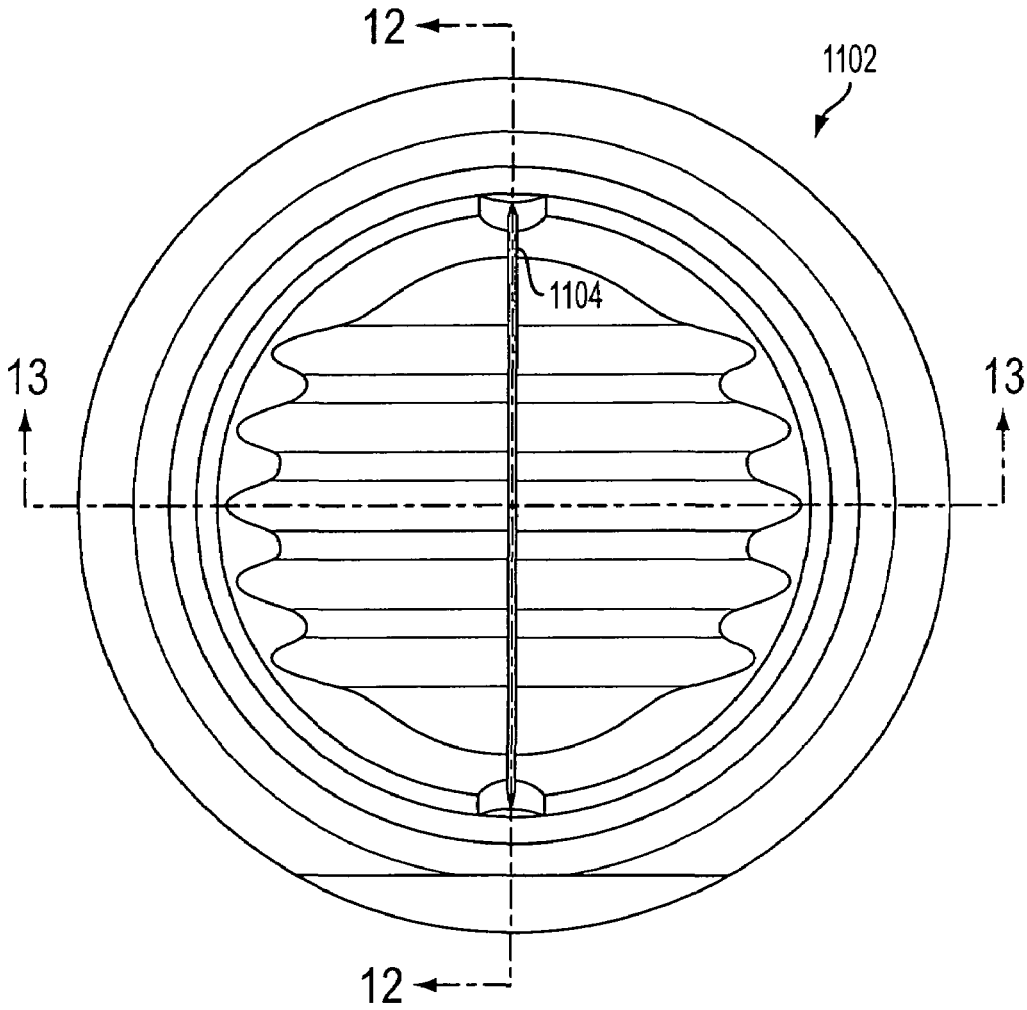
FIG. 11 depicts an exemplary embodiment of a fourth embodiment of a container base according to the present invention.
Figure 12:
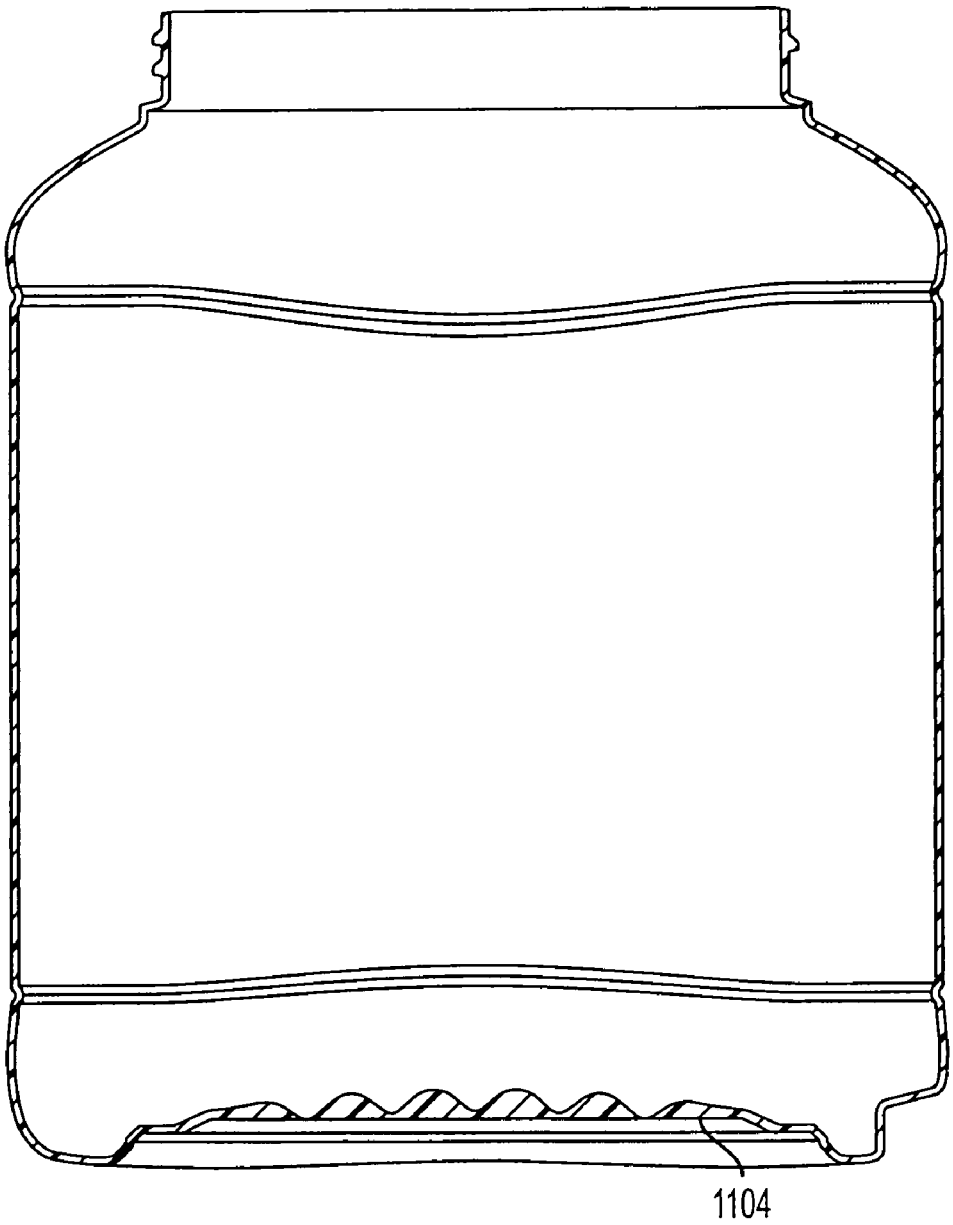
FIG. 12 depicts a cross-section of the container base shown in FIG. 11 along the line 12—12.
Figure 13:
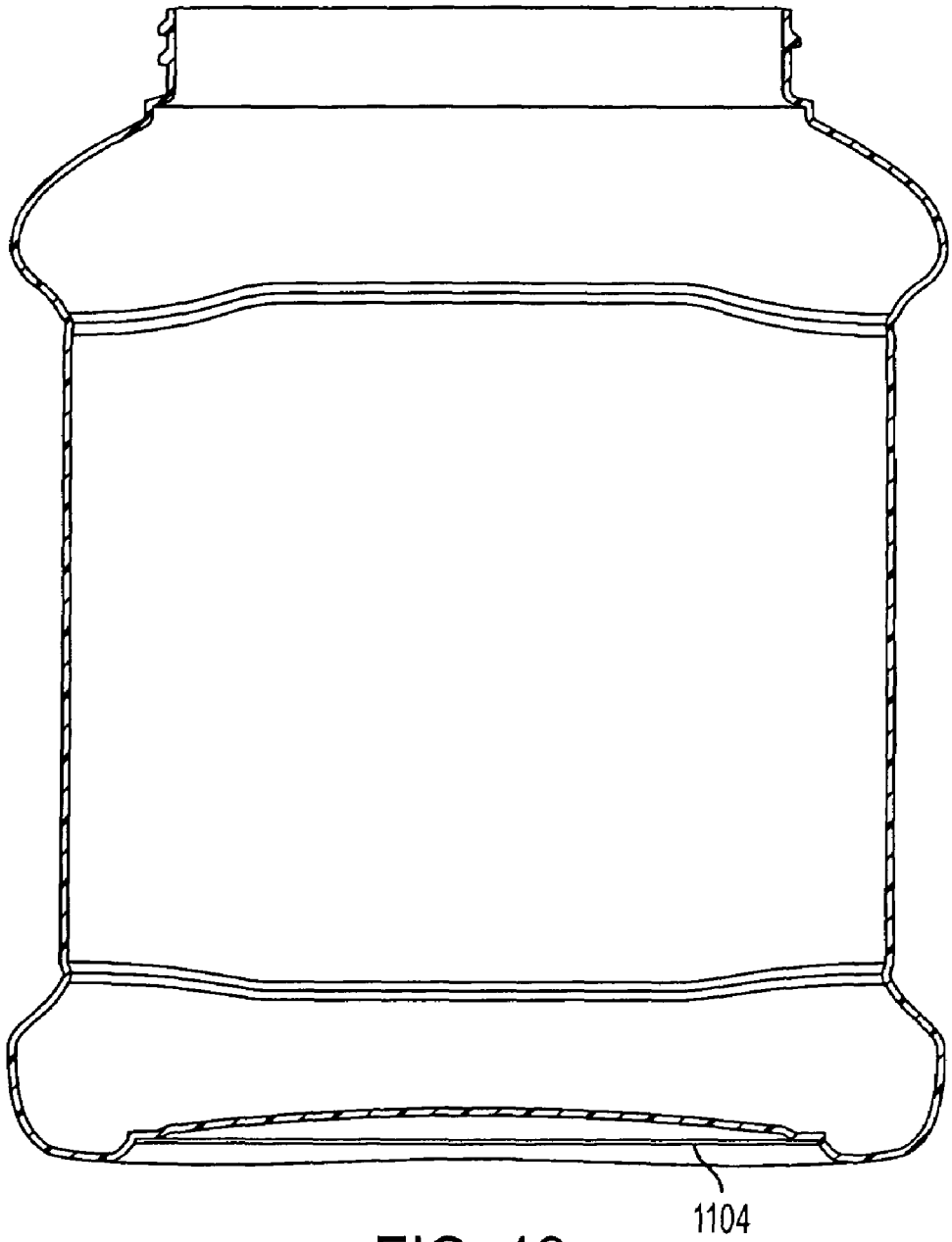
FIG. 13 depicts a cross-section of the container base shown in FIG. 11 along the line 13—13.

FIG. 11 depicts an exemplary embodiment of a fourth embodiment 1102 of a container base according to the present invention. FIG. 12 depicts a cross-section of the container base 1102 shown along the line 12—12 in FIG. 11. FIG. 13 depicts a cross-section of the container base 1102 shown along the line 13—13 in FIG. 11. Base 1102 is substantially similar to base 502, and further includes a substantially linear seam 1104. The seam 1104 may be extended into a fin to provide additional structural support to the base.

A container having a base according to the embodiments of present invention is capable of withstanding pasteurization processes used in packaging. For example, when used in a container holding about 107 fl. oz. (3165 mL) of product and having dimensions similar to a standard #10 can, the base can withstand temperatures of up to about 200 F to 205 F, and pressures of up to about 16.0 PSIA.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A container base for a container having a sidewall, the base comprising:

a standing ring defining a touch point for contact with a horizontal surface, the standing ring having an outer portion and an inner portion, the outer portion merging with the container sidewall;

a stacking ring having an inner portion and an outer portion, wherein said outer portion merges with said inner portion of said standing ring; and a substantially circular recessed portion coupled to said inner portion of said stacking ring, comprising:

a plurality of substantially flat concentric rings recessed from said stacking ring, wherein each ring is recessed from the next outermost adjacent ring;

a substantially flat center coupled to an inner diameter of an innermost substantially flat ring and recessed therefrom; and a cross-brace extending from said stacking ring into said substantially flat center.

2. The container base of claim 1, wherein said cross-brace is substantially co-planar with said stacking ring.

3. The container base of claim 1, wherein said cross-brace comprises:

a bent cross-brace having a first leg and a second leg joined at a bend, wherein said bend contacts said substantially flat center and each of said first and second legs extends outwardly from said bend up to said stacking ring in contact with each of said plurality of substantially flat concentric rings.

4. The container base of claim 3, wherein said bend, and said first and said second legs of said cross brace form an approximate right angle.

5. The container base of claim 3, further comprising at least two bent cross-braces.

6. The container base of claim 5, further comprising a substantially linear seam bisecting said base, wherein said at least two bent cross-braces are arranged each on opposite sides of said seam.

7. The container base of claim 6, further comprising a fin extending from said seam.

8. The container base of claim 5, wherein said at least two bent cross-braces are arranged such that said first leg of said first cross-brace and said first leg of said second cross-brace are substantially co-linear, and said second leg of said first cross-brace and said second leg of said second cross-brace are substantially co-linear.

9. The container base of claim 1, wherein said cross-brace extends from one side of said stacking ring, through said substantially flat center to an opposite side of said stacking ring.

10. The container base of claim 9, further comprising a second cross-brace extending from one side of said stacking ring, through said substantially flat center to an opposite side of said stacking ring, wherein said second cross-brace intersects said first cross-brace.

11. The container base of claim 1, further comprising a plurality of cross-braces extending from said stacking ring into said substantially flat center.

12. The container base of claim 1, wherein said plurality of substantially flat concentric rings comprises:

a first substantially flat ring recessed from said stacking ring;

a second substantially flat ring coupled to an inner diameter of said first substantially flat ring and recessed therefrom; and a third substantially flat ring coupled to an inner diameter of said second substantially flat ring and recessed therefrom.

13. The container base of claim 1, wherein said stacking ring is stackable.

14. A container base for a container having a sidewall, the base comprising:

a standing ring defining a touch point for contact with a horizontal surface, the standing ring having an outer portion and an inner portion, the outer portion merging with the container sidewall;

a stacking ring having an inner portion and an outer portion, wherein said outer portion merges with said inner portion of said standing ring; and a substantially circular recessed portion coupled to said inner portion of said stacking ring and recessed therefrom, comprising:

a substantially circular recessed wall merging with said stacking ring; and a corrugated support panel having an outer diameter merging with said recessed wall, and having substantially parallel corrugations extending from a first side of said recessed portion to an opposite second side of said recessed portion and merging with said recessed wall.

* * * * *